US006588622B1

(12) United States Patent
Leishman et al.

(10) Patent No.: US 6,588,622 B1
(45) Date of Patent: Jul. 8, 2003

(54) BEVERAGE CONTAINER WITH BAFFLE SYSTEM

(76) Inventors: Jason T. Leishman, 1320 S. 3rd West, Missoula, MT (US) 59801; Roy Bart Summers, P.O. Box 428, Middleton, ID (US) 83644

( * ) Notice: Subject to any disclaimer, the term of this patent is extended or adjusted under 35 U.S.C. 154(b) by 0 days.

(21) Appl. No.: 10/142,726

(22) Filed: May 9, 2002

Related U.S. Application Data

(60) Provisional application No. 60/290,165, filed on May 9, 2001.

(51) Int. Cl.[7] ..... B65D 1/02; B65D 23/00; B65D 25/04

(52) U.S. Cl. ..... 220/719; 220/706; 220/734; 215/306; 215/388; 215/6

(58) Field of Search ..... 215/6, 229, 388; 220/705, 706, 709, 719, 734; 239/33, 289

(56) References Cited

U.S. PATENT DOCUMENTS

| | | | | | |
|---|---|---|---|---|---|
| 1,847,879 | A | * | 3/1932 | Knecht | 215/388 X |
| 2,362,354 | A | | 11/1944 | Clovis | |
| 2,428,056 | A | | 9/1947 | Wachsman | |
| 2,815,879 | A | * | 12/1957 | Hermes | 215/229 X |
| 2,979,267 | A | * | 4/1961 | Miller | 215/388 X |
| 3,099,565 | A | * | 7/1963 | Neuhauser | 215/388 X |
| 3,181,725 | A | * | 5/1965 | Friedl | 220/375 |
| 3,211,379 | A | * | 10/1965 | Burton | 215/388 X |
| 3,220,587 | A | * | 11/1965 | Griffin et al. | 215/388 |
| 3,400,855 | A | | 9/1968 | Alexander | |
| 4,272,768 | A | | 6/1981 | Rookard, Jr. | |
| 4,550,848 | A | | 11/1985 | Sucato | |
| 4,750,631 | A | | 6/1988 | Hastings | |
| 5,738,234 | A | * | 4/1998 | Harrold | 215/386 |
| 6,264,057 | B1 | * | 7/2001 | Kim | 220/706 |
| 6,398,064 | B1 | * | 6/2002 | Cornwall | 220/731 |
| 6,403,137 | B1 | * | 6/2002 | Frutin | 426/477 |
| 6,478,180 | B1 | * | 11/2002 | Dehn, Sr. | 220/375 |

* cited by examiner

*Primary Examiner*—Sue A. Weaver
*Assistant Examiner*—B Ross
(74) *Attorney, Agent, or Firm*—Richard C. Conover

(57) ABSTRACT

A beverage container having a baffle system which may be inserted into the container for reducing the splashing sound caused by sloshing within the container. The baffle system of the present invention includes an elongate tubular core having a longitudinal axis. A plurality of deformable fins are attached to the tubular core in spaced apart relation along the longitudinal axis of the core. Each fin extends in a direction perpendicular to the longitudinal axis of the core. Each fin has a generally disc shape and includes radial slits through the fin to allow water to pass between the slits within the bottle. The central core is hollow and may be used as a straw for drawing liquid from the container by a user.

6 Claims, 4 Drawing Sheets

BEVERAGE CONTAINER WITH BAFFLE SYSTEM

This application claims benefit of provisional application Ser. No. 60/290,165 filed May 9, 2001.

BACKGROUND OF THE INVENTION

The present invention relates generally to beverage containers, and more particularly to those beverage containers including apparatus for limiting the sloshing of liquid contained therein. Such containers may be used by hikers, hunters, campers and the like.

A problem well recognized in the field is the sound caused by sloshing of liquid within a partially-filled water bottle, for example. Hunters, bird watchers and others want to be as quiet as possible when walking through the countryside. The sloshing of the water within the water bottle causes sound which may disturb wildlife while hunting or bird watching, and is annoying to persons using such water bottles.

Baffle systems for canteens to prevent liquid splashing sounds are known. See, for example, U.S. Pat. No. 4,272,768 to Rookard, Jr. and U.S. Pat. No. 4,550,848 to Sucato. The Rookard, Jr. patent shows a baffle system which is fixed within the canteen and the Sucato patent shows a baffle system for use with canteens which is insertable into a canteen for eliminating or substantially reducing splashing within the container.

SUMMARY OF INVENTION

The present invention relates to a beverage container having a baffle system which may be inserted into the container, such as a water bottle, for reducing the splashing sound caused by sloshing within the container. The baffle system of the present invention includes an elongate tubular core having a longitudinal axis. A plurality of deformable fins are attached to the tubular core in spaced apart relation along the longitudinal axis of the core. Each fin extends in a direction perpendicular to the longitudinal axis of the core. Each fin has a generally disc shape and includes radial slits through the fin to allow water to pass between the slits within the bottle. The central core is hollow and may be used as a straw for drawing liquid from the container by a user.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
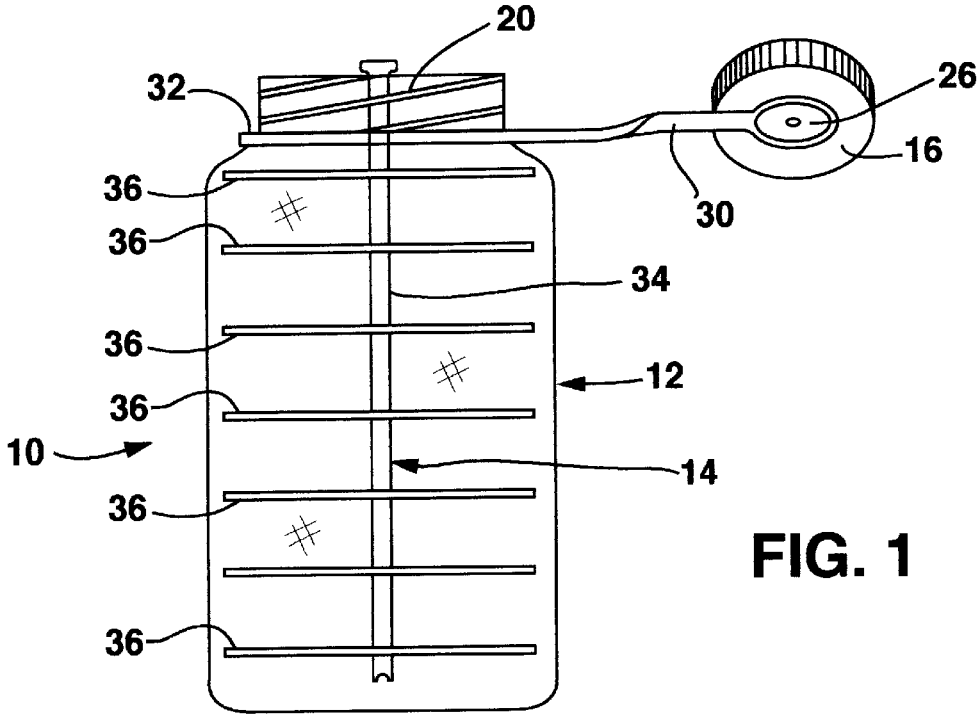
FIG. 1 is a perspective view of the present invention.

A beverage container with a baffle system 10 according to the present invention, is shown in FIG. 1. The invention 10 includes a wide mouth bottle 12 within which a baffle system 14 is inserted. A cap 16 is used to close the open mouth of bottle 12.

Figure 3:
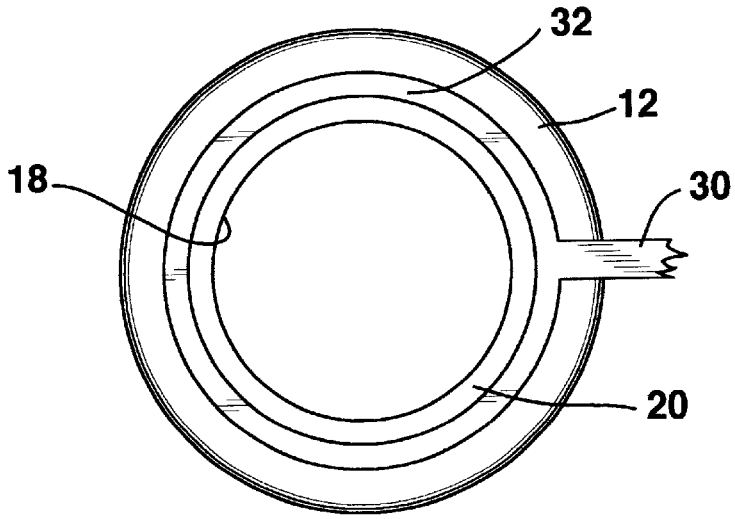
FIG. 3 is a top view of the beverage container shown in FIG. 2.
Figure 2:
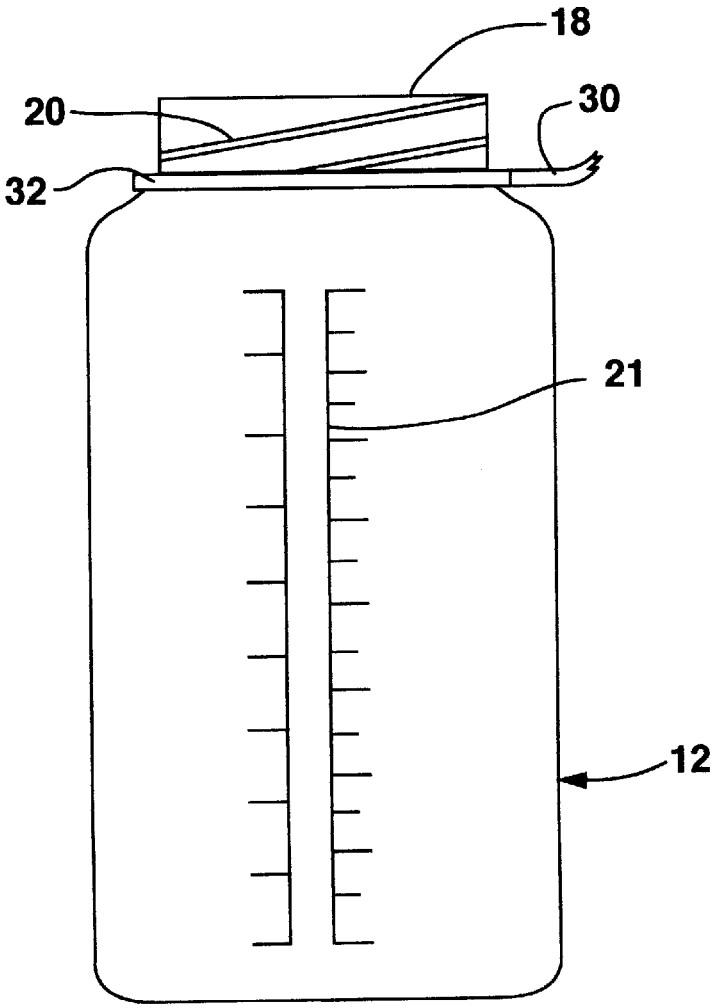
FIG. 2 is an elevational view of a beverage container used with the present invention.

The wide mouth open bottle 12 is shown in FIGS. 1–3. In a preferred embodiment, the bottle 12 is constructed of transparent plastic material, but other materials could be used equally as well. The bottle 12 includes a mouth 18. The top of the bottle 12 is provided with threads 20 for receiving the threaded cap 16. A graduated scale 21, as shown in FIG. 2, may be printed on the bottle 12 to indicate the volume of liquid contained within the bottle 12.

Figure 5:
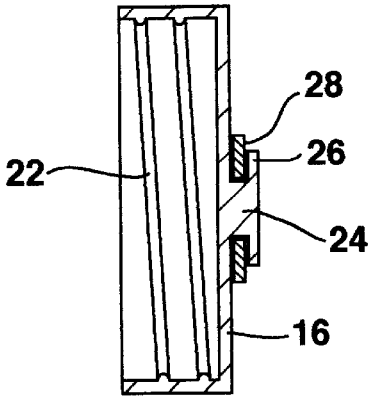
FIG. 5 is a cross-sectional view taken along line 5—5 in FIG. 4.
Figure 4:
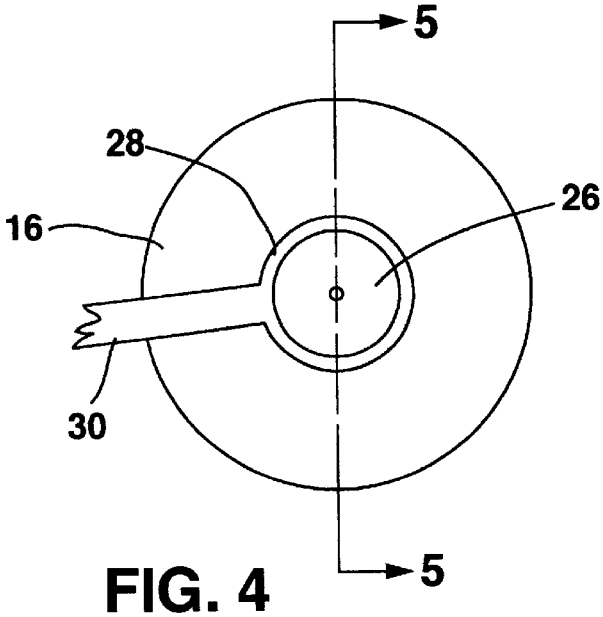
FIG. 4 is a top view of a cap used with the present invention.

The cap 16 is shown in FIGS. 1, 4 and 5. The cap 16 is provided with interior threads 22 for mating with the bottle threads 20, as shown in FIG. 5. The cap 16 is further provided with a post 24 having one end secured to an exterior surface of cap 16, and the other end secured to an enlarged stop 26. An elastic ring 28 is forced over the stop 26 in surrounding relation to post 24, as shown in FIGS. 4 and 5. The stop 26 prevents the elastic ring 28 from being easily removed from post 24. A retaining.strap 30 has one end secured to the ring 28. The other end of retaining strap 30 is secured to an elastic ring 32 which is forced over the threads 20 of the bottle 12 to be elastically retained adjacent the mouth of bottle 12, as shown in FIGS. 1 and 2.

The baffle system 14 is shown in FIGS. 1, 6, 7 and 8. The baffle system 14 includes an elongate tubular core 34 to which are mounted a plurality of deformable fins 36. The tubular core 34 is hollow and has an axial hole 35 extending the entire length of core 34. The core 34 further includes a lip 38 at a top end thereof. At the bottom end of core 34, cutouts 40 are provided. The lip 38 provides a grip for removal of the baffle 14 from the mouth of the bottle, and the cutout 40 allows liquid to flow into the hollow interior of core 34.

Figure 6:
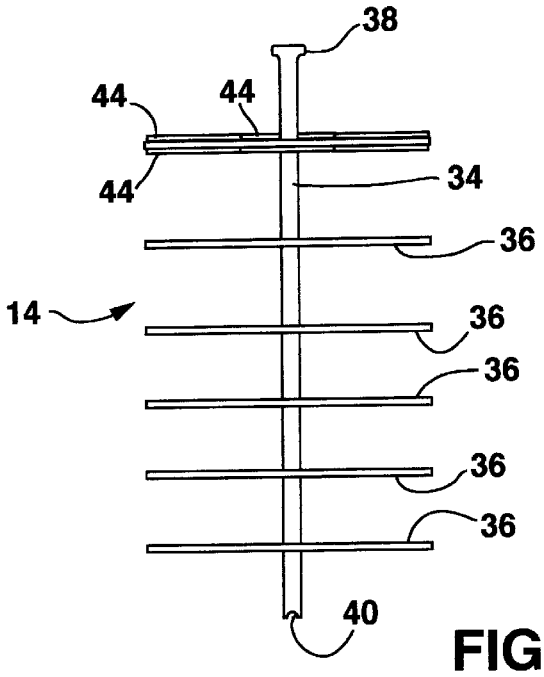
FIG. 6 is an elevational view of a baffle system used with the present invention.
Figure 7:
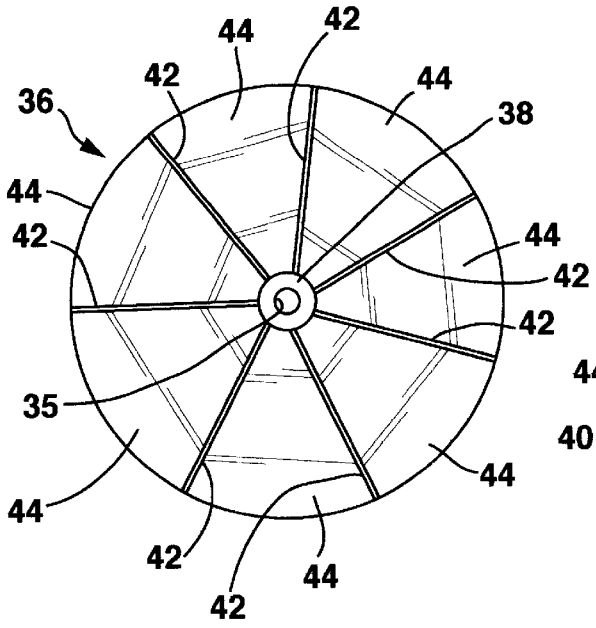
FIG. 7 is a top view of the baffle system shown in FIG. 6.
Figure 8:
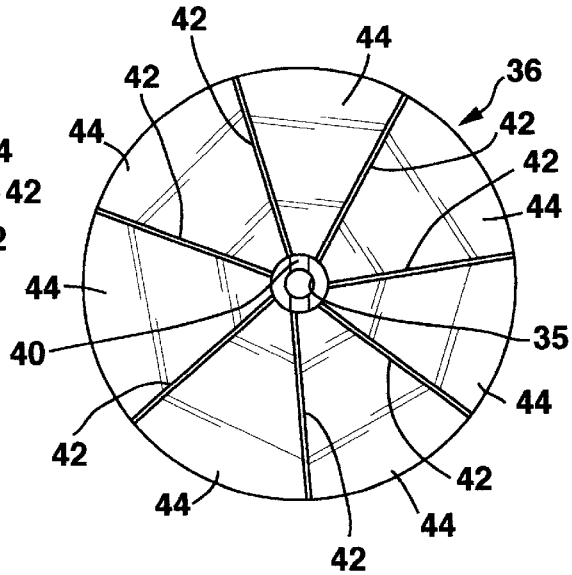
FIG. 8 is a bottom view of the baffle system shown in FIG. 6.

The fins 36 are mounted to core 34 in spaced apart relation along a longitudinal axis of the core 34. A fin 36 is shown in FIGS. 7 and 8. In a preferred embodiment, each fin 36 has a generally disc shape and is sized to snugly fit against an interior wall of the bottle 12. Further, each fin 36 includes a plurality of radial slits 42 defining a pie-shaped section 44 between adjacent slits. Each fin is constructed of a resilient material, such as plastic, such that when the fin 36 is deformed under pressure and the pressure released, the fin 36 reforms to its normal undeformed state. The pie-shaped sections 44 are free to move either up or down, as shown in FIG. 6.

In using the present invention 10, the cap 16 is removed from the bottle 12. The baffle system 14 is then inserted with the cutout end 40 of the core 34 inserted first through the open mouth 18 of bottle 12. The core 34 is forced downwardly causing the fins 36 to deform and slide through the mouth of the bottle 12. The baffle is inserted until the core 34 touches the bottom wall of the bottle 12. After the fins 36 are inserted, they expand to their undeformed state. The bottle is then filled with liquid, such as water, and the cap 16 threaded onto the bottle 12. The slits 42 allow water to pass between adjacent fins in a restricted manner to prevent sloshing of the water within the bottle 12. When it is desired to take a drink from the bottle 12, the cap 16 is removed and the user drinks fluid from the hollow core 34, using it as a straw. When the drinking has been completed, the user may then replace the cap 16 on the bottle 12 for storage.

Figure 9:
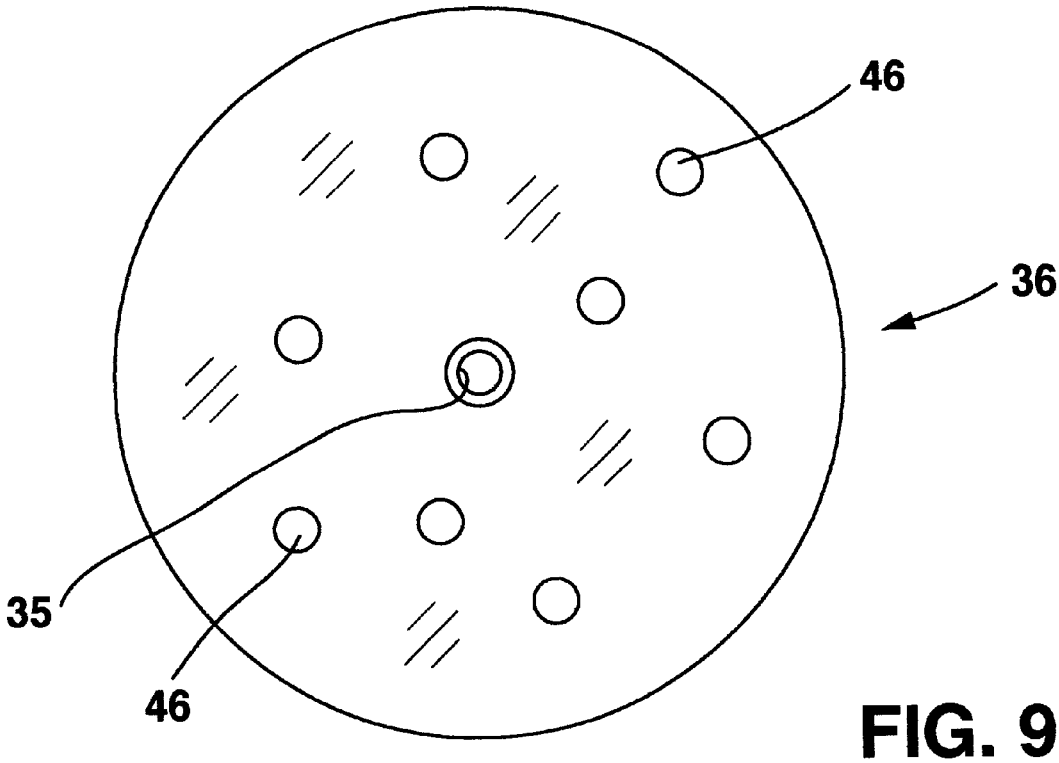
FIG. 9 is a top view of an alternate fin design used with the present invention.

An alternate fin design is shown in FIG. 9. The fin 36 in this embodiment is again formed of deformable material. Instead of slits 42, however, a series of perforations 46 are provided in the fin. The perforations allow water to move between the fins in a restricted manner to prevent sloshing.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims.

We claim:

1. A beverage container with baffle comprising:

a beverage container having a mouth opening at one end;

a cap means for selectively closing the mouth opening; and a baffle system comprising:

an elongate tubular core having a longitudinal axis;

a plurality of fins attached to the hollow core in a spaced apart relation along the longitudinal axis of the core;

each fin extending outwardly from the core in a direction perpendicular to the longitudinal axis of the core;

each fin having a generally disc shape and constructed of a resilient material whereby each fin, when inserted through the mouth opening, will deform to allow passage through the opening and then expand to its normal undeformed shape; and each fin including a plurality of spaced apart slits extending in a radial direction to an outer circumference of the fin.

2. The beverage container with baffle according to claim 1 wherein the mouth of the bottle includes exterior threads and the cap means includes interior threads for mating with the exterior threads of the bottle.

3. The beverage container with baffle according to claim 1 further including a retaining strap having one end connected to the bottle and an opposite end connected to the cap means.

4. The beverage container with baffle according to claim 1 wherein a top end of the tubular core is provided with a lip.

5. The beverage container with baffle according to claim 1 wherein a bottom end of the tubular core is provided with a cutout fluidly connecting the interior of the tubular core with the exterior of the tubular core.

6. A beverage container with baffle comprising:

a beverage container having a mouth opening at one end;

a cap means for selectively closing the mouth opening; and a baffle system comprising:

an elongate tubular core having a longitudinal axis;

a plurality of fins attached to the hollow core in a spaced apart relation along the longitudinal axis of the core;

each fin extending outwardly from the core in a direction perpendicular to the longitudinal axis of the core;

each fin having a generally disc shape and constructed of a resilient material whereby each fin, when inserted through the mouth opening, will deform to allow passage through the opening and then expand to its normal undeformed shape; and each fin including a plurality perforations extending through each fin for allowing liquid flow therethrough.

* * * * *